US005279365A

United States Patent [19]

Yenulis et al.

[11] Patent Number: 5,279,365

[45] Date of Patent: Jan. 18, 1994

[54] ROTARY BLOWOUT PREVENTER ADAPTABLE FOR USE WITH BOTH KELLY AND OVERHEAD DRIVE MECHANISMS

[75] Inventors: Glenn Yenulis, Adger; Clint Folsom, Birmingham, both of Ala.

[73] Assignee: Folsom Metal Products, Inc., Bessemer, Ala.

[21] Appl. No.: 2,140

[22] Filed: Jan. 11, 1993

Related U.S. Application Data

[62] Division of Ser. No. 733,688, Jul. 22, 1991, Pat. No. 5,178,215.

[51] Int. Cl.[5] ..... F21B 33/03

[52] U.S. Cl. ..... 166/84; 175/195; 277/31

[58] Field of Search ..... 166/80, 84; 175/195; 277/9, 27, 31

[56] References Cited

U.S. PATENT DOCUMENTS

| | | | |
|---|---|---|---|
| 3,492,007 | 1/1970 | Jones | 166/84 X |
| 4,098,341 | 7/1978 | Lewis | 175/195 X |
| 4,448,255 | 5/1984 | Shaffer et al. | 175/195 X |
| 4,531,580 | 7/1985 | Jones | 166/84 |
| 5,022,472 | 6/1991 | Bailey et al. | 166/84 X |

*Primary Examiner*—William P. Neuder
*Attorney, Agent, or Firm*—Veal & Associates

[57] ABSTRACT

An improved rotary blowout preventer having a rotary housing rotably mounted within an outer housing and carrying an annular packer assembly hydraulically actuated by fluid circulated through the outer housing by hydraulic pumps. An annular adapter is detachably and reattachably connected to an upper rim of the rotary housing. The adapter has a tubular, elastomeric sleeve detachably and reattachably connected thereto that depends within the rotary housing adjacent the packer assembly. A drill pipe is received within the sleeve and is sealably engaged thereby when the packer assembly is urged inwardly by the circulated hydraulic fluid. The sleeve protects the packer assembly from wear and is easily replaced with other sleeves of like configuration. The sleeve has a plurality of rigid grippers seated therein which extend flush with an inner surface thereof for gripping the drill pipe to facilitate concomitant rotation of the sleeve and rotary housing therewith. The circulating pumps have a heat exchanger connected thereto for cooling the hydraulic fluid which reduces the internal temperature of the rotary blowout preventer to extend the operating life of various bearing and seal assemblies commonly found therein. Filters are provided to remove foreign particulate matter dislodged from the outer casing by the circulating hydraulic fluid.

13 Claims, 5 Drawing Sheets

85
86
92
91
93
57
68
16
24
37
69
33
32
31
34
36
38
39
46
47
58
61
59
53
52
41
44
28
18
12
84
42
49
48
51
43
71
62
23
17
11

ROTARY BLOWOUT PREVENTER ADAPTABLE FOR USE WITH BOTH KELLY AND OVERHEAD DRIVE MECHANISMS

This is a division of application Ser. No. 07/733,688, filed Jul. 22, 1991 now U.S. Pat. No. 5,178,215.

FIELD OF THE INVENTION

The present invention relates to rotary blowout preventers having internal sleeves through which a drill pipe or kelly is received and more particularly relates to such rotary blowout preventers having hydraulics to urge the sleeve in sealing abutment with the drill pipe or kelly received therein. In even greater particularity the present invention relates to rotary blowout preventers having means embedded within the sleeve for gripping the pipe or kelly to facilitate concomitant rotation of the sleeve therewith.

BACKGROUND OF THE INVENTION

Rotary blowout preventers are commonly used in the petroleum industry to isolate wellbore fluids while drilling procedures are being conducted. Typically a casing spool having a discharge portal thereon is provided for the wellbore fluid to exit through. The rotary blowout preventer is connected to and supported on the casing spool and receives a drill string therethrough which is rotated to facilitate drilling of the wellbore.

One method for rotating the drill string is to extend an elongated, cross-sectionally polygonal kelly through an engine driven rotary table housed in the drill deck. The table has a polygonal bushing orifice therein through which the kelly is received. The kelly is connected to the uppermost joint of drill pipe forming the drill string to rotate the same under the rotating influence of the rotary table. Rotary blowout preventers are provided that can sealingly engage the kelly while it rotates. One such blowout preventer is disclosed in U.S. Pat. No. 3,492,007 issued to Jones on Jan. 27, 1970. Jones provides a hexagonal split kelly bushing for gripping a hexagonal kelly. The kelly bushing is connected to a rotary housing in the blowout preventer to secure the housing to the kelly for concomitant rotation therewith. The rotary housing carries an elastomeric packer assembly therein that sealingly engages the kelly. The packer assembly rotates with the rotary housing and is not subjected to rotary forces from the kelly because of the hexagonal kelly bushing's connection to the rotary housing. Such connection promotes concomitant rotation of both the rotary housing and the packer assembly with the kelly. Without connection to the kelly bushing, the kelly would rotate relative to the packer assembly and would wear or otherwise damage the elastomeric packer, requiring replacement thereof.

A second method for rotating the drill string is to use an overhead drive connected to an uppermost section of drill pipe for rotating the same. No kelly is used so one section of the cylindrical drill pipe is always positioned within the rotary blowout preventer during rotation of the drill string. The cylindrical nature of drill pipe presents a problem for conventional blowout preventers since a rigid bushing that will engage the pipe's cylindrical surface and still permit the longitudinal movement of the drill pipe through the bushing is unavailable in the industry. Furthermore, each drill pipe has an expanded diameter collar on one end to facilitate connection thereof with the next adjacent drill pipe. Longitudinal movement of the drill pipe through a rigid bushing would be prohibited by the expanded diameter collar.

As previously mentioned, direct contact of the elastomeric packer assembly with a rotating kelly or drill pipe will result in rapid wear or even spontaneous disintegration of the packer. As packers such as the inner packer shown in Jones are relatively expensive and time consuming to replace, direct contact thereof with the drill pipe is not advised.

Additionally, the seals and bearings commonly found in rotary blowout preventers are particularly susceptible to wear from heat generated by the temperature of wellbore fluids and the friction commonly occurring with such rotary bearings and seals. Foreign particulate matter suspended in the rotary blowout preventer is also a common element promoting the wear of such seals and bearings. Once the seals and/or bearings have been worn, they must be replaced. As shown in Jones, the seals and bearings are commonly seated deep within the outer casing of the blowout preventer and require substantial effort and time to replace.

SUMMARY OF THE INVENTION

It is the principal object of the present invention to provide a rotary blowout preventer that will sealingly engage either a rotating kelly or drill pipe for concomitant rotation therewith without suffering wear or other damage to the packer elements seated therein.

In support of the principal object, another object of the present invention is to provide an easily replaceable elastomeric sleeve that is detachably seated within the rotary housing intermediate the drill pipe and the packer assembly for isolating the packer assembly from the drill pipe.

Yet another object of the present invention is to provide an elastomeric sleeve as set forth above having rigid grippers seated within an inner surface thereof for gripping the drill pipe for concomitant rotation therewith to thereby reduce the wear on the detachable sleeve.

Still another object of the present invention is to provide a blowout preventer, having all the aforesaid characteristics, that removes particulate matter from the bearing and seal assemblies.

A further object of the present invention is to provide a rotary blowout preventer that cools the bearing and seal assemblies.

These and other objects and advantages of my invention are accomplished through the use of a rotary blowout preventer having an outer housing and a rotary housing rotably mounted within the outer housing. The rotary housing carries an annular elastomeric packer assembly and is supported in the outer housing by bearings. Seals are provided at the upper and lower ends of the outer and rotary housing to prevent wellbore fluids from migrating therepast.

A sleeve assembly is detachably connected to a rim portion of the rotary housing and depends therefrom within the rotary housing adjacent the packer assembly. The sleeve assembly includes an annular adapter having a suspension flange supported on the rim portion of the rotary housing. The annular adapter has a plurality of splines thereon which are inserted through and below a plurality of notches defined in the rim. The splines are rotated below the rim to lock the adapter thereto. A lock pin extends through the suspension flange and is received within the rim to secure the adapter in non-rotating relation thereto. A tubular elastomeric sleeve is detachably connected to the annular adapter and depends therefrom adjacent the packer assembly. A rigid securing ring is connected to an upper margin of the elastomeric sleeve and is detachably connected to the adapter by bolts. A rigid support ring is connected to a lower margin of the elastomeric sleeve to maintain the circular integrity thereof.

Rigid gripper elements constructed of hardened epoxy resin or steel are received within the elastomeric sleeve and extend inwardly therefrom to present a flat gripping face flush with the inner surface of the sleeve. The grippers have a greater coefficient of friction than the elastomeric nitrile rubber from which the sleeve is constructed and are less susceptible to damage due to their rigid construction. The grippers engage a drill pipe received within the rotary blowout preventer when the packer assembly and sleeve are urged inwardly by hydraulic fluid circulated through the outer housing. The grippers grasp the drill pipe to facilitate concomitant rotary movement of the sleeve assembly, rotary housing and packer assembly therewith when the drill pipe is rotated during drilling operations.

The packer assembly and sleeve are urged inwardly by a pair of motor driven hydraulic pumps which circulate hydraulic fluid from a reservoir and through the outer housing. Orifices in the rotary housing permit the hydraulic fluid to pass behind the packer assembly and urge the packer assembly and sleeve inwardly toward the drill pipe. The circulated hydraulic fluid provides the necessary pressure to actuate the packer assembly and also removes foreign particulate matter from the bearings and seals. A heat exchanger is connected to and communicates with the reservoir and the pumps for cooling the hydraulic fluid and thereby reduces the temperature of the bearings and seals the fluid comes in contact with. By maintaining a lower temperature in the blowout preventer, the working life of the bearings, seals and packer assembly will be significantly extended. The pressure inside the outer housing and within the wellbore is monitored by transducers which iteratively transfer this information to a computer. The computer is electronically connected to the pump's motors and, responsive to the data received from the transducers, iteratively signals the pumps to provide a sufficient pressure within the outer housing and on the packer assembly to maintain a predetermined pressure differential above the pressure occurring in the wellbore. Manual override apparatus is provided to allow an operator to disengage the computer means and remotely and manually operate the pumps.

BRIEF DESCRIPTION OF THE DRAWINGS

Apparatus embodying features of my invention are depicted in the accompanying drawings which form a portion of this disclosure and wherein:

FIG. 6 is a schematic view of the present invention; and

DESCRIPTION OF THE PREFERRED EMBODIMENT

Figure 1:
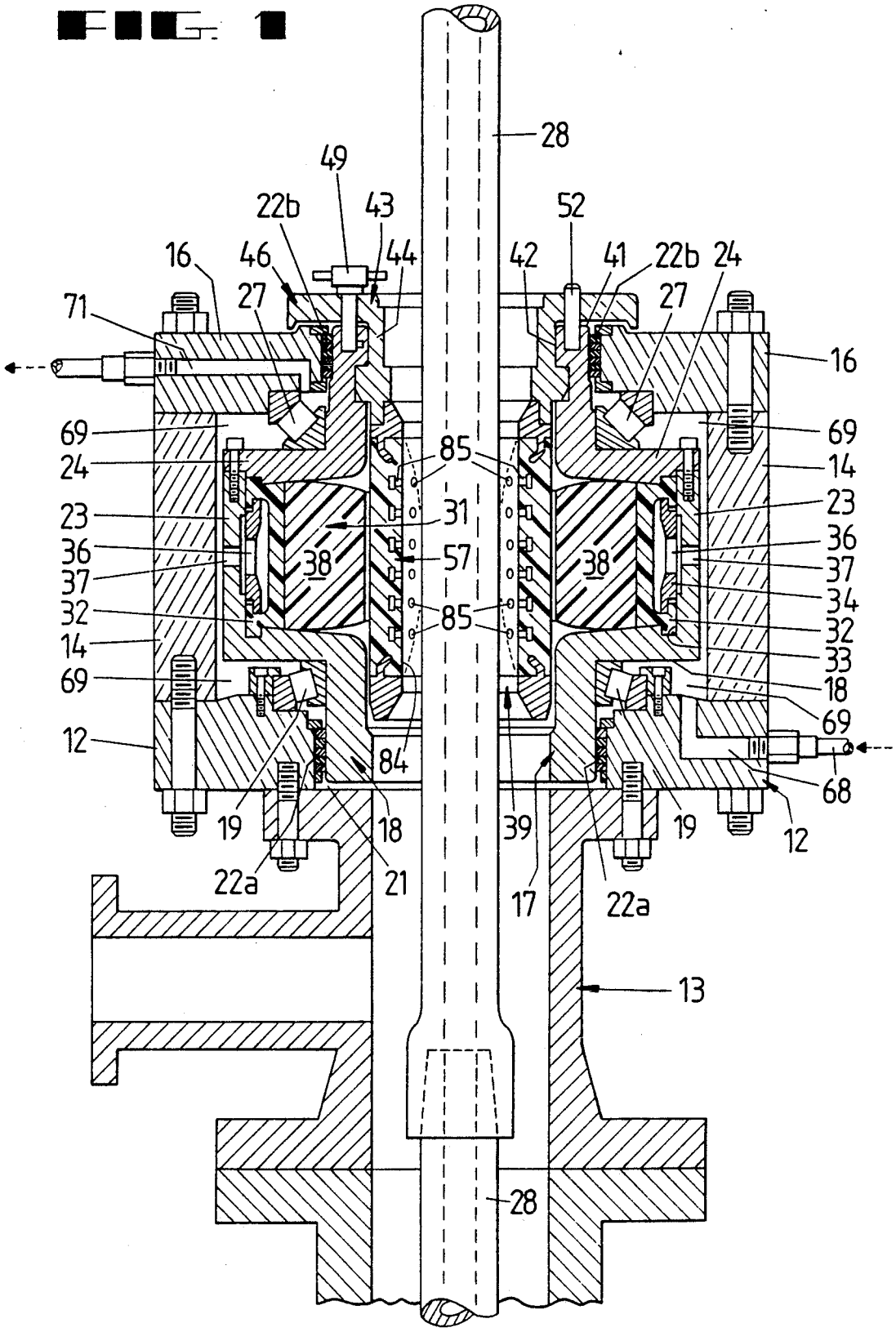
FIG. 1 is a sectional view of the present invention connected to and supported on a casing spool.
Figures 2, 7:
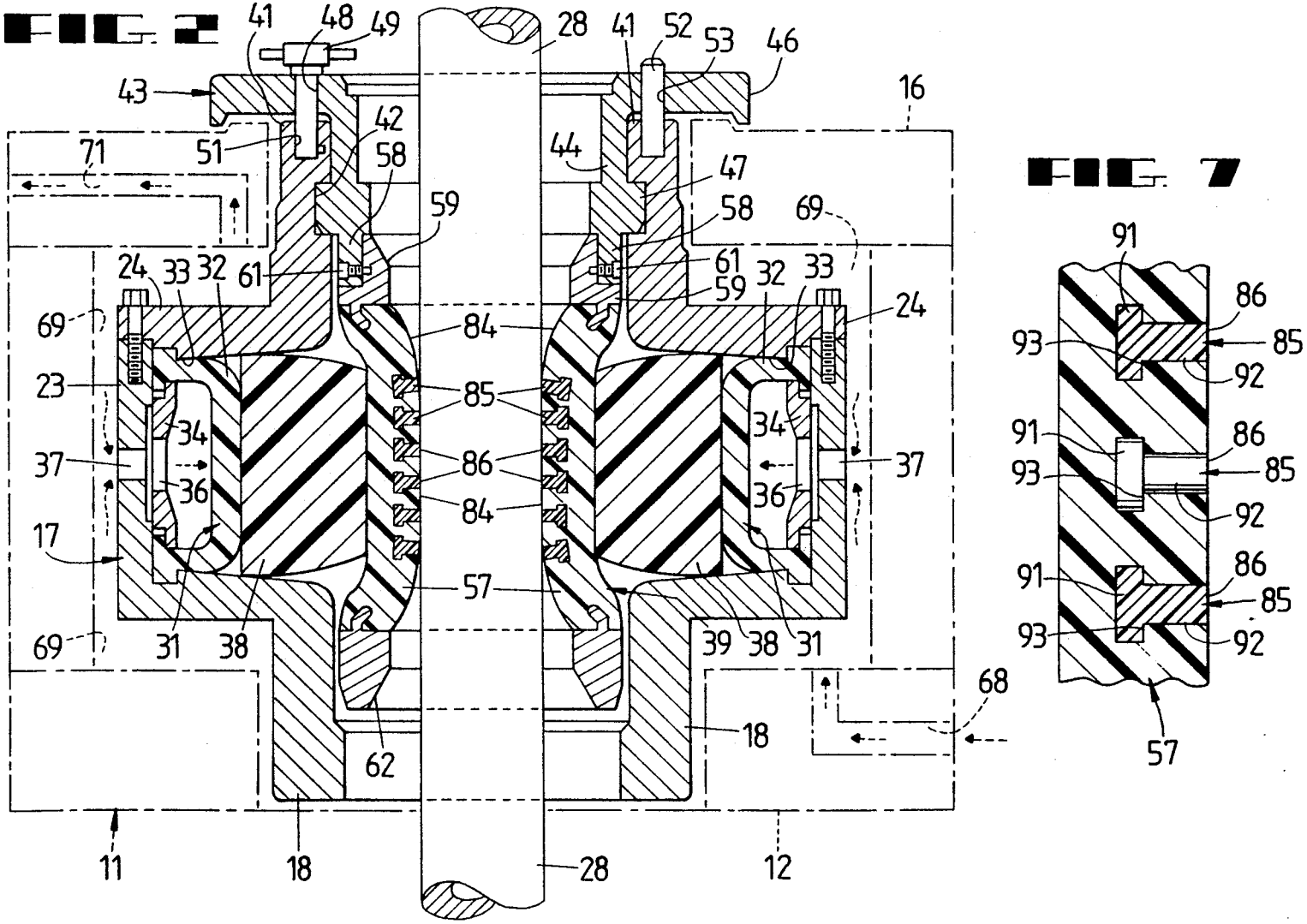
FIG. 2 is an enlarged sectional view of the present invention with the outer housing generally shown in phantom lines.
FIG. 7 is an enlarged detailed sectional view of the elastomeric sleeve with a singular gripper element shown in elevation.

As shown in FIGS. 1 and 2, the present invention is a rotary blowout preventer including an outer housing 11 having a bottom body flange 12 typically connected to and in communication with a casing spool 13. The outer housing 11 further includes a cylindrical main body 14 connected to the bottom body flange 12 and a top body flange 16 connected to the main body 14 opposite the bottom body flange 12. A rotary housing 17 is rotably connected to and encased within the outer housing 11 and includes a rotary housing base 18 rotably supported on the bottom body flange 12 by a bearing assembly 19 connected to the rotary housing base 18. The rotary housing base 18 is received within a bore 21, which extends through the bottom body flange 12 and extends in coaxial relation thereto to communicate with the casing spool 13. The rotary housing base 18 is sealingly engaged within the bore 21 by a seal assembly **22*a*. The rotary housing 17 further includes an enlarged diameter rotary packer housing 23 connected to and integral with the rotary housing base 18 for rotary movement therewith about a vertical axis. A rotary housing cover 24 is connected to the rotary packer housing 23 opposite the rotary housing base 18. The rotary housing cover 24 extends within a bore 26 defined in the top body flange 16 and is laterally engaged therein by a bearing assembly 27 connected thereto. The rotary housing cover 24 is sealingly engaged within the bore 26 by a seal assembly 22*b***.

As shown in FIGS. 1 and 2, a drill pipe 28 is typically received within the rotary housing 17 and is rotated about its longitudinal axis by an overhead drive mechanism (not shown). To isolate wellbore fluids (not shown) below the rotary packer housing 23, packer assembly 31 is provided to selectively engage the drill pipe 28 in sealing abutment therewith. The packer assembly 31 includes an elastomeric outer packer 32 seated within the rotary packer housing 23 and cooperatively held in proximate relation with an inner surface 33 thereof by a retainer ring 34, the rotary packer housing 23 and the rotary housing cover 24. The retainer ring 34 defines a series of orifices 36 spaced around the circumference thereof that are aligned with orifices 37 extending through the rotary packer housing 23. The orifices 36 and 37 permit hydraulic fluid (not shown) that is selectively injected within the outer housing to compress the outer packer inwardly. An elastomeric inner packer 38 is concentrically positioned inwardly from the outer packer 32 and is thus urged inwardly by the motion of the outer packer 32.

As shown in FIGS. 1,2 and 3–5, a quick change elastomeric sleeve assembly 39 is detachably connected to an upper rim 41 of the rotary housing cover 24 and is suspended within the rotary housing 17 inwardly of the inner packer 38. The rim 41 defines a plurality of spaced apart inwardly opening notches 42. An annular packer sleeve adapter 43 is received within and is detachably connected to the rotary housing cover 24 for concomitant rotation therewith. The annular adapter 43 includes a substantially tubular body 44 having a suspension flange 46 integrally connected to and extending outwardly from an upper margin thereof. The suspension flange 46 rests on the rim 41 when the adapter 43 is received within the rotary housing cover 24 and supports the body 44 therein. A plurality of splines 47 are integrally and externally connected to body 44 in spaced relation to the rim 41 and in cooperative relation to the notches 42. The rim 41 and splines 47 cooperate to lock the adapter 17 within the rotary housing cover 24.

Figure 5:
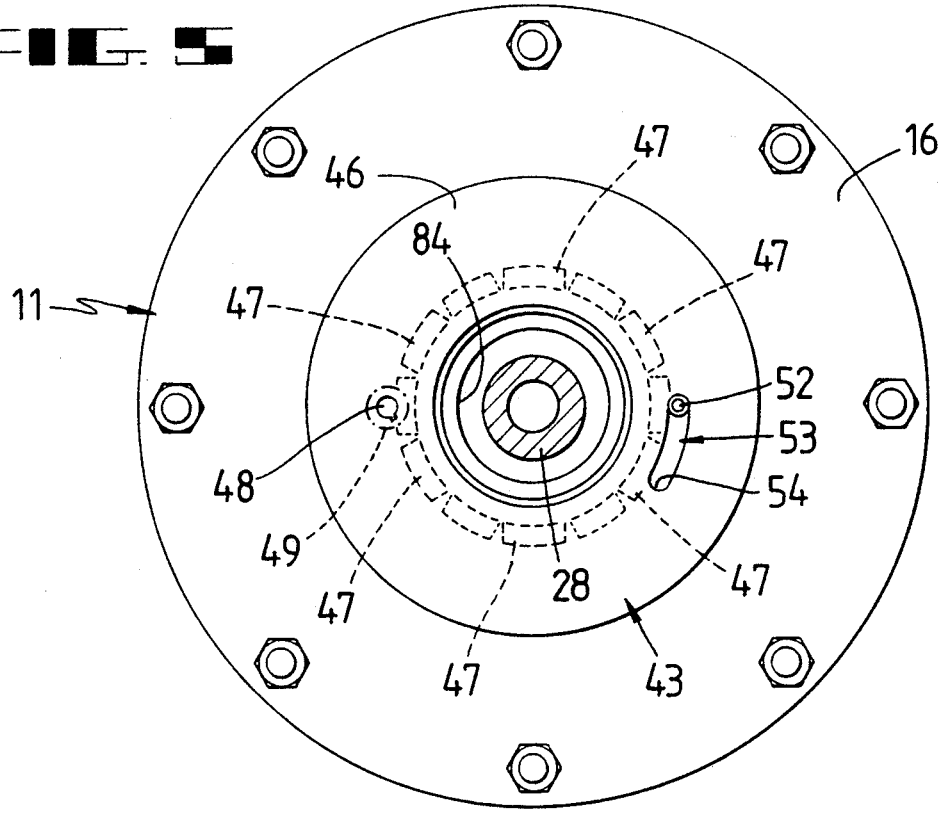
FIG. 5 is a plan view of the present invention in a locked position.
Figure 5:
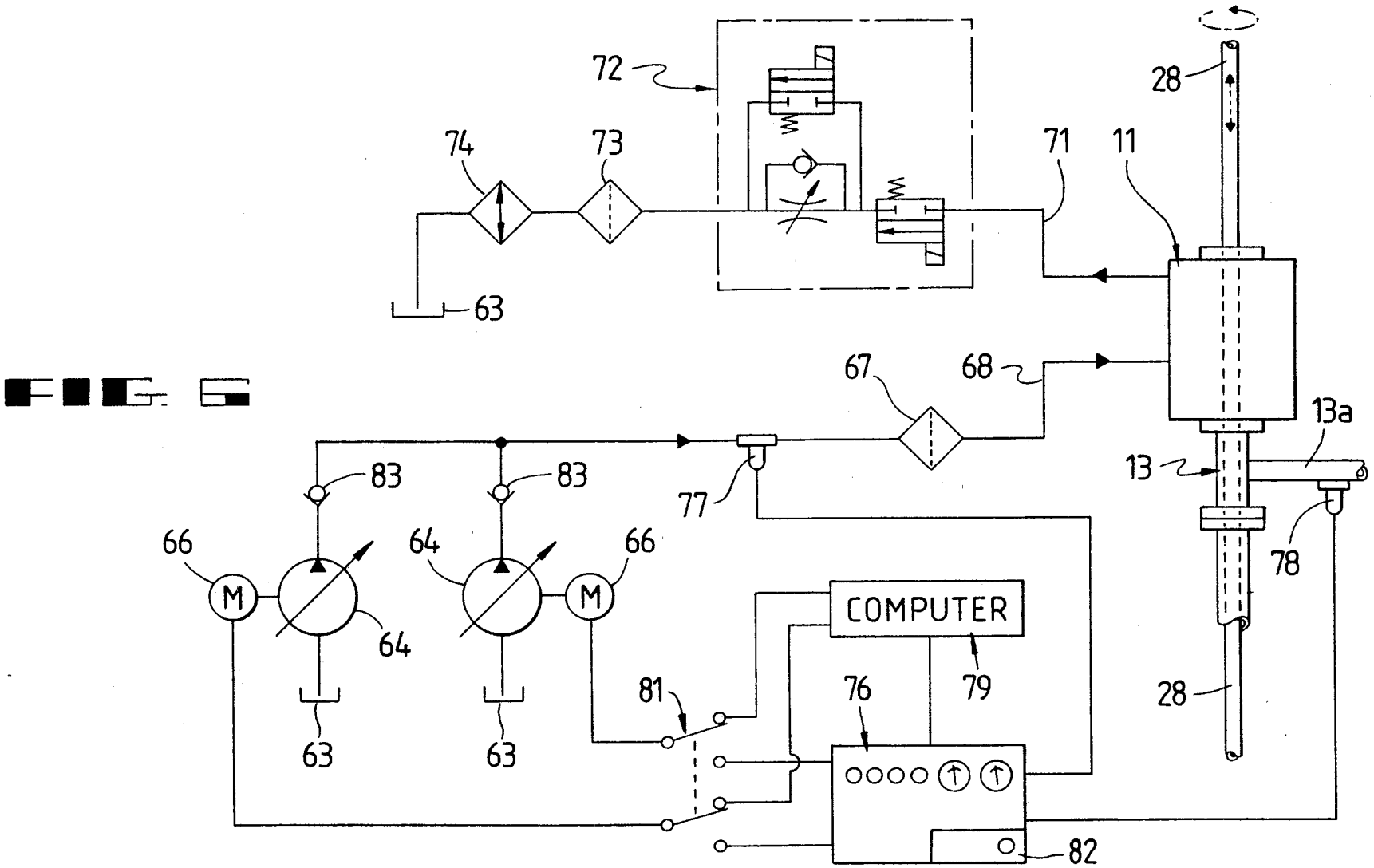

When the adapter 43 is received within the rotary housing cover 24, the splines 47 are received within and pass below the notches 42 to an unlocked position shown in FIG. 5. The suspension flange 46 rests on the rim 41 and supports the splines 47 just below the notches 42. As shown in FIG. 6, the annular packer sleeve adapter 43 and splines 47 connected thereto are manually rotated a predetermined angular distance to offset the splines 47 from the notches 42 and thereby place the adapter 43 and the splines 42 in an axially locked position.

Figure 3:
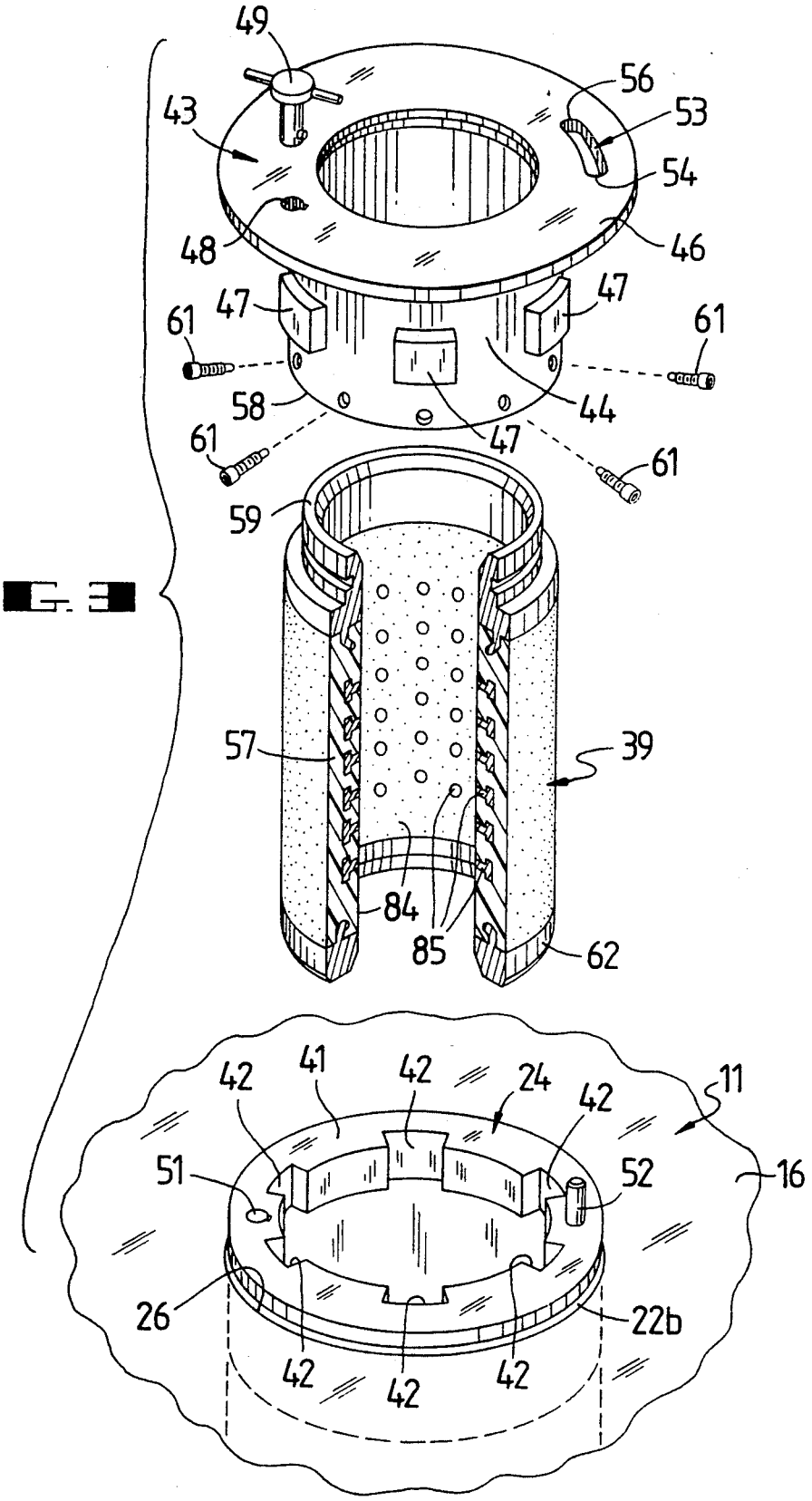
FIG. 3 is an exploded perspective view, partially in section, of a detachable sleeve assembly and rim.
Figure 4:
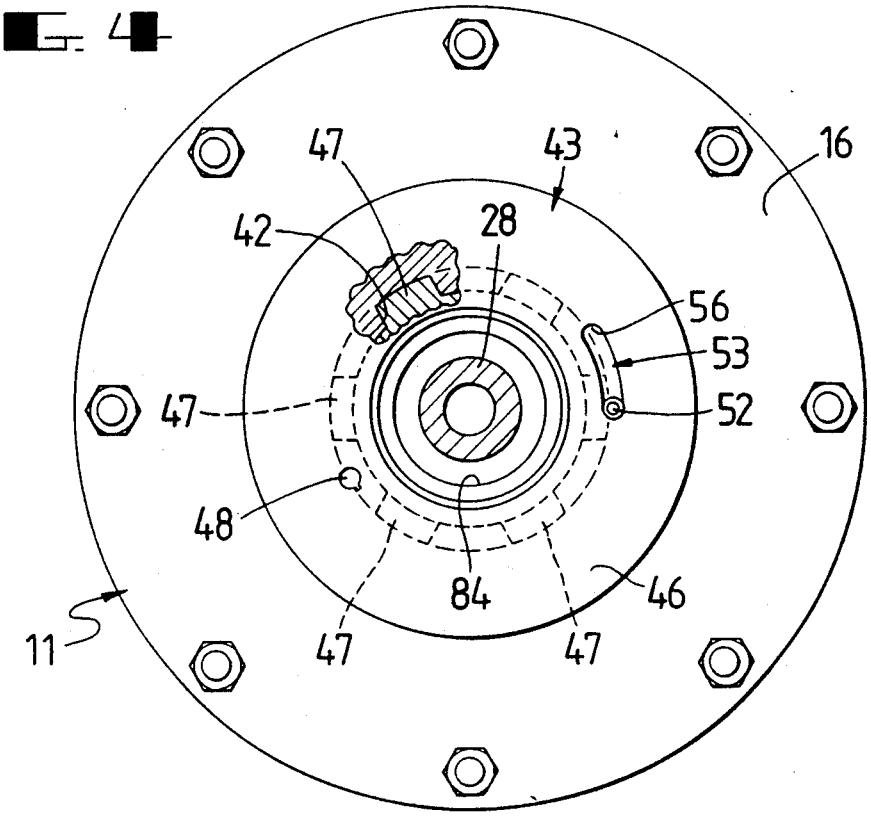
FIG. 4 is a partially broken plan view of the present invention in an unlocked position.

As shown in FIG. 3, an aperture 48 extends through the suspension flange 46 for receiving therethrough a lock pin 49 which is received in a hole 51 defined in rim 41. As shown in FIGS. 1 and 2, the pin 49 secures the suspension flange 46 to the rim 41 and secures the adapter 43 in nonrotating relation to the rotary housing cover 24. As shown in FIGS. 5 and 6, a pin 52 is integrally connected to the rim 41 in diametrically opposed relation to hole 24 and extends upwardly therefrom within a curved slot 53 concentrically defined in the suspension flange 46. The pin 52 and slot 53 indicate when the adapter is in either a locked or unlocked position and further assist in aligning the aperture 48 with hole 51. When the splines 47 are inserted through the notches 42, with the slot 53 positioned above the pin 52, the pin 52 will be received within the slot 53 at a first predetermined end 54 thereof and will thereby indicate that the adapter 43 is in the unlocked position. Rotation of the adapter 43 to urge the opposite or second predetermined end 56 of the slot 53 in abutment with the pin 52 will urge the adapter 43 into the locked position and will align the aperture 48 with hole 51. The lock pin 49 can then be inserted in hole 51 and engaged therein by rotating the lock pin 49, thus to securing the adapter 43 in the locked position.

An elastomeric sleeve 57, shown in FIGS. 1, 2 and 3, is detachably and reattachably connected to a lower end 58 of the annular adapter 43 and depends therefrom within the rotary housing 17. The sleeve 57 is connected at an upper end to a rigid securing ring 59 which is detachably connected to a lower end of the adapter 43 by bolts 61 The sleeve 57 engages the drill pipe 28 extending therethrough and is selectively urged inwardly in sealing contact with the pipe 28 by the inward compression of inner packer 38. A rigid support ring 62 is connected to a lower end of the elastomeric sleeve 57 and prevents the upward movement of the drill pipe from folding the sleeve inwardly within itself.

The outer packer 32, the inner packer 38 and elastomeric sleeve 57 are selectively urged inwardly by circulated hydraulic fluid (not specifically shown) introduced within the outer housing 11 and injected through orifices 36 and 37. As shown in FIG. 6, the hydraulic fluid is circulated from a reservoir 63 located outside the outer housing 11. The hydraulic fluid is circulated by a pair of piston pumps 64 connected to the reservoir 63 and driven by motors 66. Hydraulic fluid discharged from pumps 64 passes through a discharge filter 67 connected thereto which is connected to and communicates with the outer housing 11 through input line 68.

As shown in FIGS. 1 and 2, hydraulic fluid flowing through input line 68 is introduced within an annulus 69 defined intermediate the outer housing 11 and rotary housing 17. Fluid entering annulus 69 passes through orifices 36 and 37 and, as the pressure generated by pumps 64 is selectively increased, selectively compresses the outer packer 32 inwardly to urge the inner packer 38 and elastomeric sleeve 57 toward the drill pipe 28. The hydraulic fluid entering the annulus 69 serves to maintain a selected pressure on the packer assembly 31 and cools the seal assemblies **22*a* and 22*b* thus extending the longevity of their use by reducing the effects of the intense heat typically generated by their contact with rotary housing 17. The circulated hydraulic fluid also cools the elastomeric outer and inner packers 32 and 38. Furthermore, foreign particulate matter, inadvertently introduced within the annulus, that naturally contributes to the wear of the seal or bearing assemblies is removed by the circulation of the fluid. Hydraulic fluid entering the annulus 69 exits the outer housing 11 through output line 71 which is connected to and communicates with the outer housing 11 in diametric relation to the input line 68. The output line 69 is connected to and communicates with a failsafe valve 72 which is connected to and communicates with a return filter 73. The discharge and return filters 67 and 73 remove particulate matter from the hydraulic fluid to reduce the wear on those components of the invention contacted thereby. The return filter 73 is connected to and communicates with a heat exchanger 74 which cools the hydraulic fluid passing therethrough to a selected temperature. The heat exchanger 74 is connected to and communicates with the reservoir 63 to complete the circulation of the hydraulic fluid. A system panel 76 is provided to monitor and control the pressure in the annulus 69. The panel 76 is electronically connected to first and second transducers 77 and 78 which are operatively connected to the input line 68 and casing line 13*a*, respectively, to monitor the pressure in the annulus 69 and casing spool 13. The transducers 77 and 78 recurrently send an electronic signal to the panel 76 continually indicating the pressures in the annulus 69 and casing spool 13. The panel 76 has a computer 79 for analyzing these signals and automatically emitting a control signal to the pumps 64. The control signal activates the pumps to maintain pressures in the annulus 69 that are a selected predetermined pressure differential above the pressure recorded in the casing spool 13. Note that pressures recorded in casing line 13*a* and casing spool 13 are directly indicative of pressures within a wellbore (not shown) therebelow. A deactivator switch 81 is connected to the computer means 79 and a manual control 82 for selectively disengaging the computer means 79 and electronically connecting the manual control 82 to the pumps 64 and motors 66 for remote but manual operation thereof. The failsafe valve 7 is electronically connected to the control panel 76 and, responsive to a total loss of power, will actuate to close the output line 71 thereby containing the pressure existing at the annulus 69 just prior to the power loss. Such pre-power loss pressure is maintained at the pumps 64 by pump outlet check valves 83** commonly connected thereto.

In operation, one of a plurality of drill pipes 28, connected in string, is received within the rotary housing 17. During drilling operations, the drill pipes 28 including the one received in the rotary housing 17 are rotated by an overhead drive mechanism (not shown). The pumps 64 are activated to provide continuous pressurized and circulated hydraulic fluid at the annulus 6 and thereby hydraulically actuate the outer and inner packers 32 and 38 inwardly to urge the elastomeric sleeve 57 in sealed abutment with the drill pipe 28 received therein. The frictional contact of the sleeve's 57 cylindrical inner surface 84 with the rotating drill pipe 28 causes the sleeve 57, adapter 43, rotary housing 17 and packer assembly 31 to rotate concomitantly therewith. If the elastomeric sleeve 57 should become worn or damaged, it can be easily disengaged from the rotary housing 17 and adapter 43 and replaced with a new sleeve of like configuration. Minimal downtime is required to replace the sleeve 57 which is relatively inexpensive in relation to the cost of replacing an inner packer 38. The sleeve 57 protects the inner packer 38 from wear, thereby eliminating the cost of continual replacement thereof.

Concomitant rotation of the sleeve 57 with drill pipe 28 is specifically facilitated by a plurality of grippers 85, seated within the elastomeric sleeve 57, as shown in FIGS. 1, 2, 3 and 7. The grippers 85 have outer faces 86 that extend flush with the inner surface 84 of the sleeve to maintain a continuous seal across the elastomeric sleeve 57 when the inner surface 84 is urged into contact with the drill pipe.

The grippers 85 are constructed of semi-rigid materials such as epoxy resin intermixed with selected granular materials such as sand or particles of carbide steel. Grippers 85 formed entirely from carbide steel or any other material having a coefficient of friction sufficient to grip the drill pipe 28 for concomitant rotation therewith and having sufficient hardness to resist destruction by the movement of the drill pipe 28 are also contemplated by the present invention.

As is shown in FIG. 7, the grippers 85 are integrally seated within the elastomeric sleeve 57. Each gripper 85 includes a cylindrical enlarged portion 91 and an elongated portion 92 integrally connected to the enlarged portion 91. The grippers 85 are seated within the elastomeric sleeve 57 by pouring the elastomeric polymer in liquid form into a mold (not shown) and around the grippers 85 spaced therein. The elastomeric sleeve 57 bonds with the grippers 85 and thus secures the grippers therein. Shoulders 93 formed by the sleeve 57 inwardly of the enlarged diameter portion further obstruct the inadvertent removal of the grippers from the sleeve 57.

One skilled in the art will recognize that the shape of the grippers 85 is not limited to the above description. Grippers having many shapes and sizes may be utilized. The outer faces 86 are shown in FIG. 7 to be flat; however, one skilled in the art will recognize that the outer faces 86 may be curved to more accurately conform to the cylindrical inner surface 84 or may be serrated to better grip the drill pipe 28.

In operation, the drill pipe 28 is received within said sleeve 57 for sliding longitudinal movement therethrough. When the pumps 64 are actuated, the fluid pumped thereby will urge the inner surface 84 and outer faces 86 in sealing contact with the drill pipe 28. The grippers 85, due to their epoxy and granular construction, are more rigid than the elastomeric sleeve 57 and exert a greater frictional force on the drill pipe 28 when urged in contact therewith by the hydraulic pumps 64. The grippers 85, under the compressive influence of the pumps 64, frictionally engage the drill pipe 28 and secure the packer assembly 31 thereto for concomitant rotary motion therewith. Such gripping action prevents slippage of the packer assembly 31 and reduces wear on the sleeve 57. The grippers 85 do not, however, grasp the drill pipe 28 so tightly as to prevent the longitudinal sliding motion thereof through the sleeve 57. The downward force exerted by the weight of the drill pipe as well as the forces necessary to lift the drill pipe 28 will easily overcome the frictional gripping force exerted by the grippers 85. From the foregoing, it should be clear the present apparatus represents a substantial improvement over the prior art.

While I have shown my invention in one form, it will be obvious to those skilled in the art that it is not so limited but is susceptible of various changes and modifications without departing from the spirit thereof.

What I claim is:

1. A quick change packer assembly for use in a rotary blowout preventer having a rotary housing rotably mounted within an outer housing for rotational movement about a vertical axis, comprising:

(a) an annular adapter received within and detachably and reattachably connected to said rotary housing for concomitant rotation therein; and (b) an annular elastomeric sleeve detachably and reattachably connected to and depending from said annular adapter within said rotary housing by bolts extending through said adapter and radially received within a rigid securing ring connected to an upper end of said sleeve for engaging a drill pipe received therein, wherein said adapter and said sleeve can be selectively retrieved from said rotary housing and replaced with another adapter and sleeve of like configuration.

2. A quick change packer assembly as described in claim 1 wherein said rotary housing comprises an internally extended rim having a plurality of internally opening notches spaced around an internal margin thereof.

3. A quick change packer assembly as described in claim 2 wherein said annular adapter, comprises:

(a) a cylindrical body received within said rotary housing in near contacting relation to said rim;

(b) a suspension flange integrally connected to an upper end of said body and extending outwardly therefrom to rest on said rim and support said body within said rotary housing; and (c) a plurality of splines integrally and externally connected to said body in spaced relation to said suspension flange and in corresponding relation to said notches defined by said rim, wherein said splines are received within said notches, when said body is received within said rotary housing, and pass below said rim to an unlocked position and are thereafter offset from said notches by rotating said annular adapter a predetermined axial distance within said rotary housing from said unlocked position to a locked position.

4. A quick change packer assembly as described in claim 3 comprising means connected to said rim and received by said suspension flange for securing said annular adapter and said splines in said locked position.

5. A quick change packer assembly as described in claim 4, wherein said securing means, comprises:

(a) at least one aperture defined by and extending through said suspension flange;

(b) at least one hole extending within said rim in coaxial relation to said aperture when said adapter is in said locked position;

(c) at least one lock pin extending through each said aperture and engaged within each said hole for securing said suspension flange in planar abutment with said rim and preventing the rotation of said annular adapter within said rotary housing.

6. A quick change packer assembly as described in claim 5 further including means for regulating the rotation of said adapter and indicating the relative position thereof to said rim comprising:

(a) a curved slot concentrically defined in said suspension flange;

(b) a pin integrally connected to said rim and extending upwardly therefrom, wherein said pin is received within said slot when said suspension flange is supported on said rim and abuts a first end of said slot when said adapter is rotated to said unlocked position and abuts a second end of said slot opposite said first end when said adapter is rotated to said locked position.

7. A quick change packer assembly for use with a rotary blowout preventer, comprising:

(a) a rotary housing rotably mounted to and engaged within said rotary blowout preventer for rotational movement about a vertical axis;

(b) an annular adapter received within said rotary housing for supporting an elastomeric sleeve therein; and (c) means connected to said rotary housing and said annular adapter for selectively locking said adapter within said rotary housing, wherein said adapter can be selectively disengaged from said rotary housing to replace said elastomeric sleeve with another sleeve of like configuration, said locking means comprising a rim integrally connected to and forming an upper margin of said rotary housing and defining a plurality of internally opening notches; a plurality of splines integrally connected to said adapter in spaced relation to said rim and in corresponding relation to said notches; and a suspension flange integrally connected to and coextending an upper end of said adapter and extending outwardly therefrom to rest on said rim for supporting said adapter within said rotary housing, wherein said adapter and said splines are placed in a locked position by inserting said splines through and below said notches, thereafter rotating said adapter a predetermined angular distance to offset said splines from said notches.

8. A quick change packer assembly as described in claim 7 further comprising means connected to said rim and received within said suspension flange for securing said annular adapter to said rotary housing in non-rotating relation thereto.

9. A quick change packer assembly as described in claim 8 wherein said securing means, comprises:

(a) at least one aperture defined by and extending through said suspension flange;

(b) at least one hole extending within said rim in coaxial relation to said aperture when said adapter is in said locked position;

(c) at least one lock pin extending through each said aperture and engaged within each said hole for securing said suspension flange in planar abutment with said rim and preventing the rotation of said annular adapter relative to said packer housing.

10. A quick change packer assembly as described in claim 8 further comprising means connected to said rotary housing and said annular adapter for securing said annular adapter to said rotary housing in non-rotating relation thereto.

11. A quick change packer assembly as described in claim 9 wherein said elastomeric sleeve is detachably and reattachably connected to a lower end of said annular adapter and depends therefrom within said rotary housing to engage a drill pipe received therein.

12. A quick change packer assembly for use with rotary blowout preventers, comprising:

(a) a rotary housing having a plurality of internally opening notches formed on an upper rim thereof;

(b) an annular adapter received within said rotary housing and supported therein and on said rim by an outwardly extending suspension flange;

(c) a plurality of splines integrally connected to and spaced around said adapter in corresponding relation to said notches, wherein said splines are inserted through and below said notches and thereafter offset therefrom to axially lock said adapter within said rotary housing; and (d) means connected to said rotary housing and defined by said rim for securing said adapter to said rotary housing in non-rotating relation thereto.

13. A quick change packer assembly as described in claim 12, wherein said securing means, comprises:

(a) at least one aperture defined by and extending through said suspension flange;

(b) at least one hole extending within said rim;

(c) at least one lock pin extending through said aperture and engaged within said hole to secure said suspension flange in to said rim and to prevent the rotation of said annular adapter relative to said rotary housing.

* * * * *